US009048051B2

(12) United States Patent
Naka et al.

(10) Patent No.: US 9,048,051 B2
(45) Date of Patent: Jun. 2, 2015

(54) ELECTROMAGNETIC CONTACTOR

(75) Inventors: Yasuhiro Naka, Kounosu (JP); Kouetsu Takaya, Kounosu (JP); Kenji Suzuki, Kounosu (JP); Takahiro Taguchi, Kounosu (JP)

(73) Assignees: FUJI ELECTRIC CO., LTD., Kawasaki-shi, Kanagawa (JP); FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 22 days.

(21) Appl. No.: 13/978,088

(22) PCT Filed: Apr. 3, 2012

(86) PCT No.: PCT/JP2012/002331

§ 371 (c)(1),
(2), (4) Date: Jul. 11, 2013

(87) PCT Pub. No.: WO2012/157174

PCT Pub. Date: Nov. 22, 2012

(65) Prior Publication Data

US 2013/0301181 A1 Nov. 14, 2013

(30) Foreign Application Priority Data

May 19, 2011 (JP) ..... 2011-112913

(51) Int. Cl.
*H01H 47/00* (2006.01)
*H01H 9/44* (2006.01)
(Continued)

(52) U.S. Cl.
CPC ..... *H01H 47/32* (2013.01); *H01H 9/443* (2013.01); *H01H 50/14* (2013.01); *H01H 50/163* (2013.01);
(Continued)

(58) Field of Classification Search
CPC ..... H01H 9/443; H01H 47/32
USPC ..... 361/160, 194, 195, 196
See application file for complete search history.

(56) References Cited

U.S. PATENT DOCUMENTS 6,911,884 B2 6/2005 Uotome et al.
8,159,807 B2 4/2012 Pohl
8,179,217 B2 * 5/2012 Kawaguchi et al. ..... 335/80

FOREIGN PATENT DOCUMENTS

CN 1489775 A 4/2004
CN 101341564 A 1/2009
(Continued)

OTHER PUBLICATIONS

China Patent Office, "Office Action for CN 201280005797.3," Dec. 1, 2014.

*Primary Examiner* — Thienvu Tran
*Assistant Examiner* — Lucy Thomas
(74) *Attorney, Agent, or Firm* — Manabu Kanesaka

(57) ABSTRACT

An electromagnetic contactor has a pair of fixed contacts disposed and fixed maintaining a predetermined interval; a movable contact disposed to be capable of contacting to and separating from the pair of fixed contacts; an electromagnet unit to drive the movable contact; and a drive circuit driving the electromagnet unit. The electromagnet unit includes at least a movable plunger urged by a return spring, a coil to move the movable plunger, and a ring-form permanent magnet magnetized in a moving direction of the movable plunger. The drive circuit includes a power source to supply power to the coil; a pulse drive circuit to output and supply to the coil an engage pulse causing the movable plunger to perform an attracting operation and a hold pulse maintaining the attracting operation when the movable plunger is subject to the attracting operation, and a flywheel circuit having a semiconductor switching element.

8 Claims, 10 Drawing Sheets

(51) Int. Cl.

| | |
|---|---|
| ***H01H 50/14*** | (2006.01) |
| ***H01H 50/16*** | (2006.01) |
| ***H01H 50/38*** | (2006.01) |
| ***H01H 51/06*** | (2006.01) |
| *H01H 9/00* | (2006.01) |
| *H01H 47/18* | (2006.01) |
| *H01H 47/32* | (2006.01) |
| *H01H 51/30* | (2006.01) |
| *H01H 51/28* | (2006.01) |
| *H01H 67/00* | (2006.01) |
| *H01H 1/00* | (2006.01) |
| *H01H 9/30* | (2006.01) |
| *H01H 1/48* | (2006.01) |
| *H01H 1/50* | (2006.01) |
| *H01H 50/42* | (2006.01) |
| *H01H 50/02* | (2006.01) |

(52) U.S. Cl.
CPC ..... *H01H 50/38* (2013.01); *H01H 51/065* (2013.01); *H01H 50/42* (2013.01); *H01H 2050/025* (2013.01)

(56) References Cited

FOREIGN PATENT DOCUMENTS

| | | | |
|---|---|---|---|
| JP | S59-181004 | A | 10/1984 |
| JP | H01-268005 | A | 10/1989 |
| JP | H09-259728 | A | 10/1997 |
| JP | 2010-062079 | A | 3/2010 |

* cited by examiner

POWER SOURCE VOLTAGE

TRANSISTOR Tr1
ON
OFF
P1
P2

COIL CURRENT

Tr2 CURRENT

VARISTOR Z CURRENT

POWER SOURCE VOLTAGE

TRANSISTOR Tr1
ON
OFF
P1
P2

COIL CURRENT

Tr2 CURRENT

VARISTOR Z CURRENT

ELECTROMAGNETIC CONTACTOR

RELATED APPLICATIONS

The present application is National Phase of International Application No. PCT/JP2012/002331 filed Apr. 3, 2012, and claims priority from Japanese Application No. 2011-112913 filed May 19, 2011.

TECHNICAL FIELD

The present invention relates to an electromagnetic contactor including fixed contacts, a movable contact capable of connecting to and separating from the fixed contacts, and an electromagnet unit that drives the movable contact.

BACKGROUND ART

An electromagnetic contactor that carries out switching of a current path is such that a movable contact is driven by an exciting coil and movable plunger of an electromagnet unit. That is, when the exciting coil is in a non-excited state, the movable plunger is urged by a return spring, and the movable contact is in a released condition wherein it is distanced from a pair of fixed contacts disposed maintaining a predetermined interval. From the released condition, the movable plunger is attracted to a fixed iron core and can be moved against the return spring by exciting the exciting coil, and the movable contact takes on an engaged condition wherein it contacts with the pair of fixed contacts (for example, refer to PTL 1).

CITATION LIST

Patent Literature

PTL 1: Japanese Patent No. 3,107,288

SUMMARY OF INVENTION

Technical Problem

Note that the heretofore known example described in PTL 1 is such that, as the contact mechanism is disposed inside a hermetic receptacle, it is possible to carry out energizing with, and interruption of, a large current. However, when using in a vehicle-mounted application used in a vehicle such as, for example, a hybrid vehicle or electric vehicle, there is a high demand not only for the guaranteed ambient temperature to be high, but also for a reduction in size of the device, meaning that there is an unsolved problem in the heretofore known example in that the exciting current flowing to the coil configuring the electromagnet is large, there is a need for a configuration that ensures attracting force and holding force and that suppresses heat emitted from the circuit parts, and the size of the overall configuration increases.

Therefore, the invention, having been contrived focusing on the unsolved problem of the heretofore known example, has an object of providing an electromagnetic contactor such that it is possible to reduce the exciting current flowing to the coil, and to reduce the overall size.

Solution to Problem

In order to achieve the heretofore described object, an electromagnetic contactor according to one aspect of the invention includes a pair of fixed contacts disposed and fixed maintaining a predetermined interval and a movable contact disposed so as to be capable of contacting to and separating from the pair of fixed contacts, an electromagnet unit driving the movable contact, and a drive circuit driving the electromagnet unit. The electromagnet unit includes at least a movable plunger urged by a return spring, a coil to move the movable plunger, and a ring-form permanent magnet, disposed to enclose a peripheral flange portion formed on the movable plunger and magnetized in a moving direction of the movable plunger. The drive circuit includes a power source to supply power to the coil, a pulse drive circuit to output and supply to the coil an engage pulse causing the movable plunger to perform an attracting operation and a hold pulse maintaining the attracting operation when the movable plunger is subject to the attracting operation by the engage pulse, and a flywheel circuit having a switching element connected in parallel to the coil.

According to this configuration, as the permanent magnet is provided so as to enclose the peripheral flange portion of the movable plunger, it is possible to cause an attracting force that enables the movable contact to move in a releasing direction to act on the movable plunger, thus reducing the urging force of the return spring. Because of this, it is possible to reduce the size of the current energizing the coil. Further, by the coil drive circuit being configured of the pulse drive circuit and flywheel circuit, it is possible for the current exciting the coil during an engagement operation and holding operation to be small.

Also, it is preferable that the electromagnetic contactor is such that the flywheel circuit includes a series circuit of a flywheel diode and switching element connected in parallel to the coil, a high impedance element connected in parallel to the semiconductor switching element, and a switch control circuit that controls the turning on and off of the semiconductor switching element based on a coil current.

According to this configuration, a holding operation at a time of a holding operation wherein a hold pulse is output from the pulse drive circuit is carried out by the turning on and off of the switching element being controlled by the switching control circuit, while a release operation is such that the switching element is put into an off-state, and the coil energy is consumed by a high impedance element, such as a varistor, connected in parallel, whereby a swift release operation is possible.

Advantageous Effects of Invention

According to the invention, it is possible to cause the attracting force of the permanent magnet to act so as to attract the movable plunger in a released condition, and thus possible to suppress by a commensurate amount the urging force of the return spring causing the movable plunger to return to the released condition. Because of this, it is possible to reduce the current energizing the coil that attracts the movable plunger. By the coil drive circuit being configured of the pulse drive circuit and flywheel circuit, it is possible for the current exciting the coil during an engagement operation and holding operation to be small. As a result of this, it is possible to reduce the size of the electromagnet unit, and to reduce the size of the drive circuit, and thus possible to achieve a reduction in cost.

DESCRIPTION OF EMBODIMENTS

Hereafter, a description will be given, based on the drawings, of an embodiment of the invention.

Figure 1:
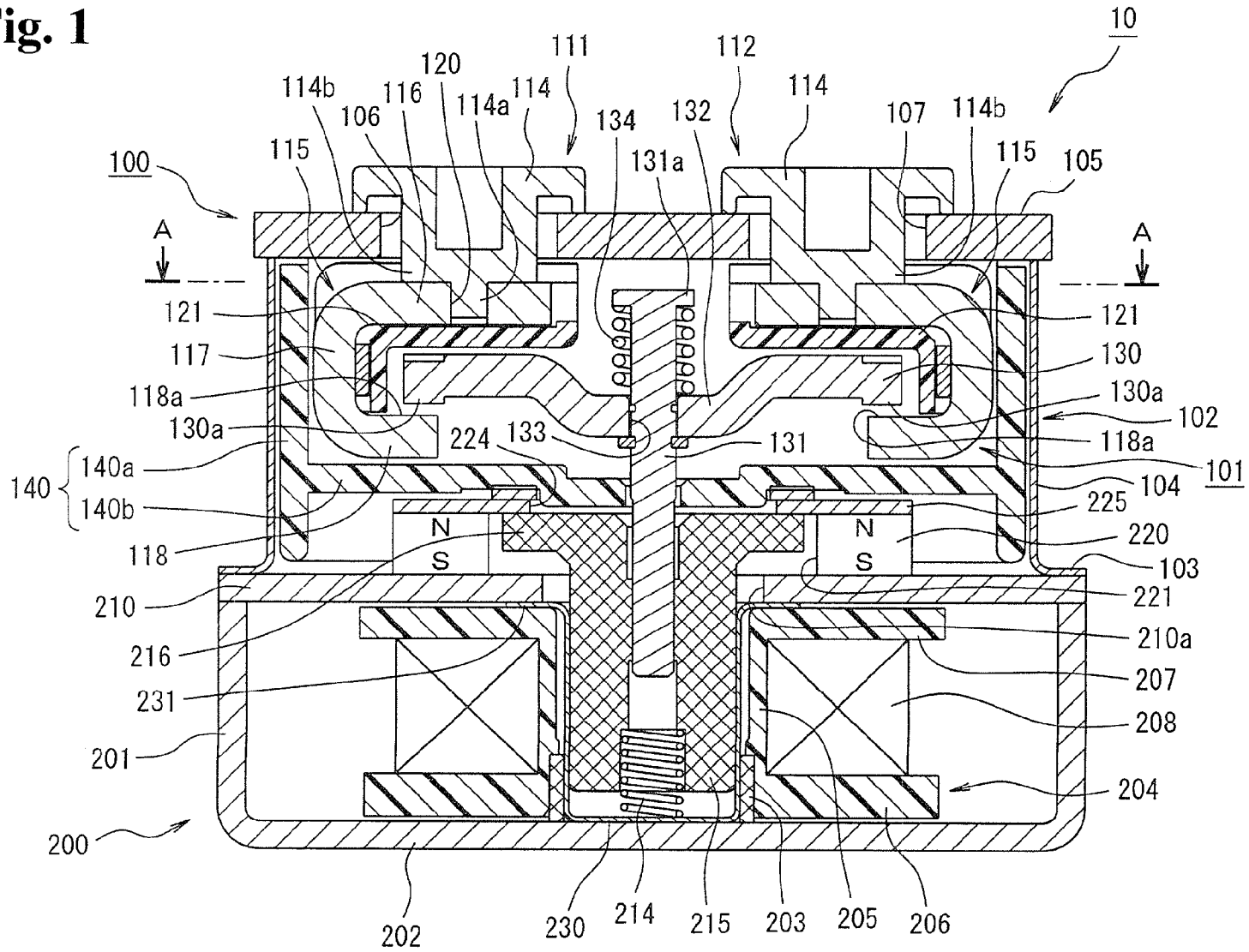
FIG. 1 is a sectional view showing a first embodiment of an electromagnetic contactor according to the invention.

FIG. 1 is a sectional view showing one example of an electromagnetic contactor according to the invention. In FIG. 1, numeral 10 is an electromagnetic contactor, and the electromagnetic contactor 10 is configured of a contact device 100 in which a contact mechanism is disposed, and an electromagnet unit 200 that drives the contact device 100.

The contact device 100 has a contact housing case 102 that houses a contact mechanism 101, as is clear from FIG. 1. The contact housing case 102 includes a metal tubular body 104 having a metal flange portion 103 protruding outward on a lower end portion, and a fixed contact support insulating substrate 105 configured of a plate-like ceramic insulating substrate that closes off the upper end of the metal tubular body 104.

The metal tubular body 104 is such that the flange portion 103 thereof is seal joined and fixed to an upper portion magnetic yoke 210 of the electromagnet unit 200, to be described hereafter.

Also, through holes 106 and 107 for inserting a pair of fixed contacts 111 and 112, to be described hereafter, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts with the tubular body 104.

The contact mechanism 101, as shown in FIG. 1, includes the pair of fixed contacts 111 and 112 inserted into and fixed in the through holes 106 and 107 of the fixed contact support insulating substrate 105 of the contact housing case 102. Each of the fixed contacts 111 and 112 includes a support conductor portion 114, having on an upper end a flange portion protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* formed protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Further, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115, as shown in FIG. 2.

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and a fitting portion 125, formed on the inward side from the upper end of the side plate portions 123 and 124, that fits onto a small diameter portion 114*b* formed on the support conductor portion 114 of the fixed contacts 111 and 112.

Figure 2:
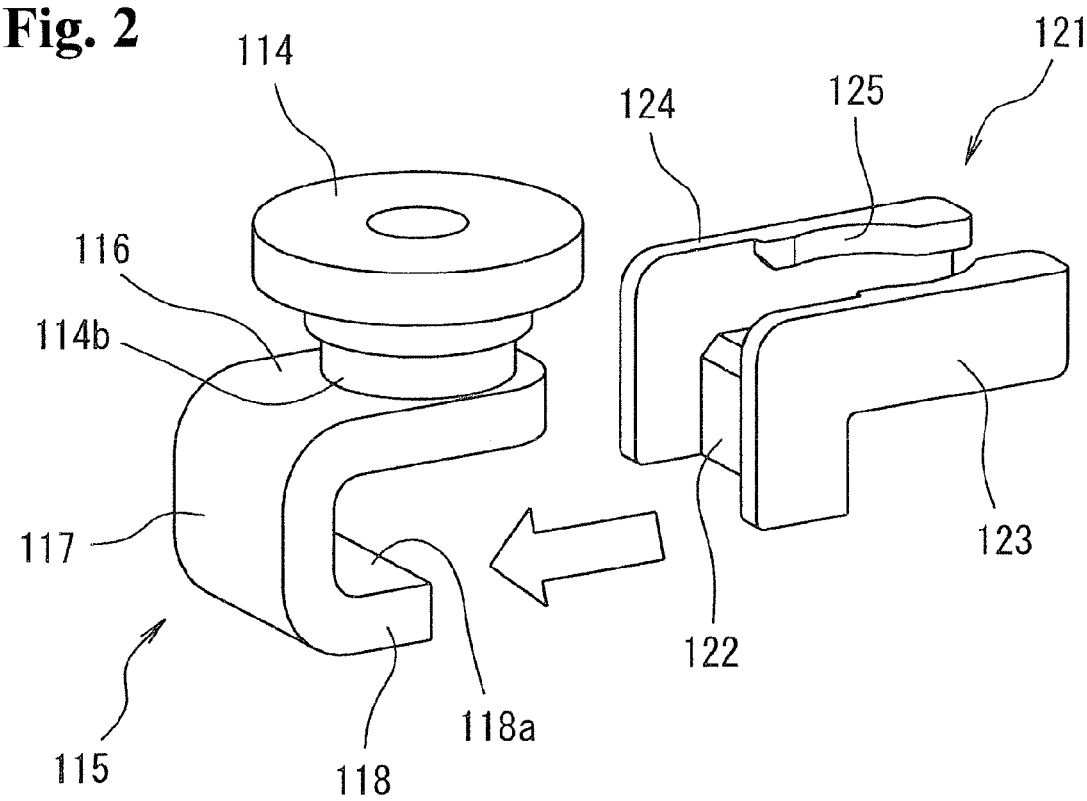
FIG. 2 is a perspective view showing an insulating cover.

Further, the insulating cover 121 is placed in a condition in which the fitting portion 125 is facing the small diameter portion 114*b* of the support conductor portion 114 of the fixed contacts 111 and 112, as shown in FIG. 2, after which, the fitting portion 125 is fitted onto the small diameter portion 114*b* of the support conductor portion 114 by pushing the insulating cover 121 onto the small diameter portion 114*b*.

By mounting the insulating cover 121 on the C-shaped portion 115 of the fixed contacts 111 and 112 in this way, only the upper surface side of the lower plate portion 118 of the inner peripheral surface of the C-shaped portion 115 is exposed, and is taken to be the contact portion 118*a*.

Further, the movable contact 130 is disposed in such a way that both end portions are disposed in the C-shaped portion 115 of the fixed contacts 111 and 112. The movable contact 130 is supported by a connecting shaft 131 fixed to a movable plunger 215 of the electromagnet unit 200, to be described hereafter. The movable contact 130 is such that, as shown in FIG. 1, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*, and the moving contact 130 is positioned using, for example, a C-ring 135 so as to obtain a predetermined urging force from the contact spring 134.

The movable contact 130, in a released condition, takes on a condition wherein the contact portions 130*a* at either end and the contact portions 118*a* of the lower plate portions 118 of the C-shaped portions 115 of the fixed contacts 111 and 112 are separated from each other and maintaining a predetermined interval. Also, the movable contact 130 is set so that, in an engaged position, the contact portions at either end contact with the contact portions 118*a* of the lower plate portions 118 of the C-shaped portions 115 of the fixed contacts 111 and 112 at a predetermined contact pressure due to the contact spring 134.

Furthermore, an insulating cylinder 140 made of, for example, a synthetic resin is disposed on the inner peripheral surface of the metal tubular body 104 of the contact housing case 102. The insulating cylinder 140 is configured of a tubular portion 140*a* disposed on the inner peripheral surface of the tubular body 104 and a bottom plate portion 104*b* that closes off the lower surface side of the tubular portion 140*a*.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed as a plunger drive portion on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 slidably up and down. A peripheral flange portion 216 protruding outward in a radial direction is formed on the movable plunger 215, on an upper end portion protruding upward from the upper magnetic yoke 210.

Also, a permanent magnet 220 formed in a ring-form is fixed to the upper surface of the upper magnetic yoke 210 so as to enclose the peripheral flange portion 216 of the movable plunger 215. The permanent magnet 220 has a through hole 221 that encloses the peripheral flange portion 216. The permanent magnet 220 is magnetized in an up-down direction, that is, a thickness direction, so that, for example, the upper end side is an N-pole while the lower end side is an S-pole. Taking the form of the through hole 221 of the permanent magnet 220 to be a form tailored to the form of the peripheral flange portion 216, the form of the outer peripheral surface can be any form, such as circular or rectangular.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 is facing the lower surface of the auxiliary yoke 225.

Figure 3:
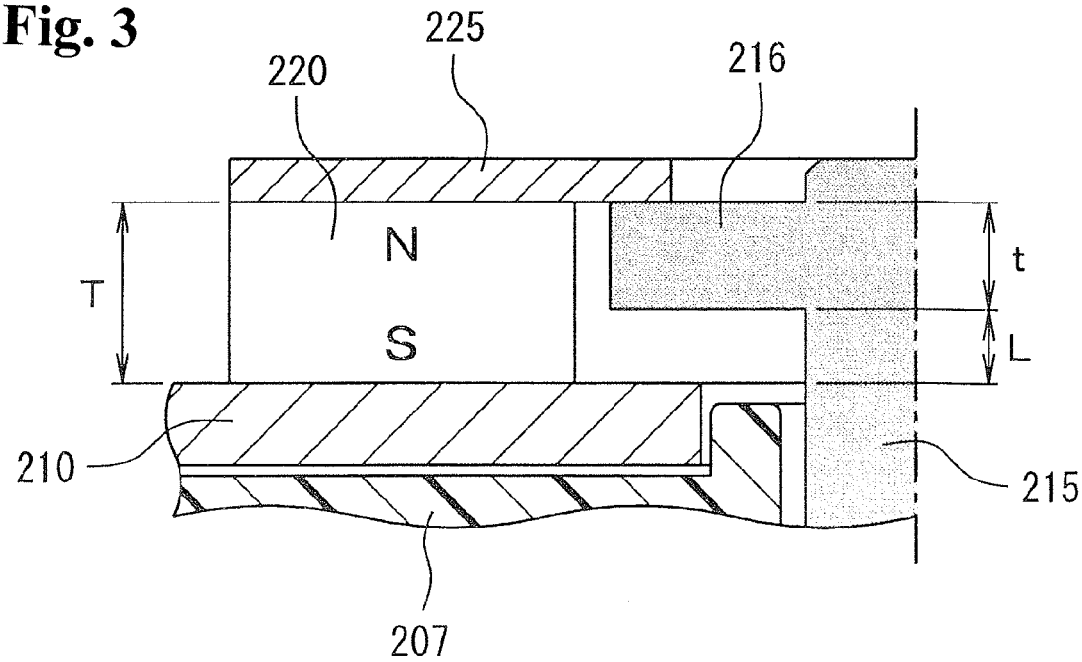
FIG. 3 is an enlarged sectional view showing the positional relationship between a permanent magnet and a movable plunger.

Herein, a thickness T of the permanent magnet 220 is set to a value (T=L+t) wherein a stroke L of the movable plunger 215 and a thickness t of the peripheral flange portion 216 of the movable plunger 215 are added together, as shown in FIG. 3. Consequently, the stroke L of the movable plunger 215 is regulated by the thickness T of the permanent magnet 220.

Because of this, it is possible to reduce to a minimum the cumulative number of parts and form tolerance, which affect the stroke of the movable plunger 215. Also, it is possible to determine the stroke L of the movable plunger 215 using only the thickness T of the permanent magnet 220 and the thickness t of the peripheral flange portion 216, and thus possible to minimize variation of the stroke L. In particular, this is more advantageous in the case of a small electromagnetic contactor in which the stroke is small.

Also, as the permanent magnet 220 is formed in a ring-form, the number of parts decrease, and a reduction in the cost is achieved. Also, as the peripheral flange portion 216 of the movable plunger 215 is disposed in the vicinity of the inner peripheral surface of the through hole 221 formed in the permanent magnet 220, there is no waste in a closed circuit passing magnetic flux generated by the permanent magnet 220, leakage flux decreases, and it is possible to use the magnetic force of the permanent magnet effectively.

The form of the permanent magnet 220 not being limited to that heretofore described, it can also be formed in an annular form, or in other words, the external form can be any form provided that the inner peripheral surface is a cylindrical surface. Also, not being limited to an annular form, the permanent magnet 220 may also be formed in an angular frame form, such as quadrilateral, hexagonal, or octagonal.

Also, the connecting shaft 131 that supports the movable contact 130 is screwed to the upper end surface of the movable plunger 215.

Further, in the released condition, the movable plunger 215 is urged upward by the return spring 214, and the upper surface of the peripheral flange portion 216 attains a released position wherein it contacts with the lower surface of the auxiliary yoke 225. In this condition, the contact portions 130*a* of the movable contact 130 have moved away upwardly from the contact portions 118*a* of the fixed contacts 111 and 112, causing a condition wherein current is interrupted.

In the released condition, the peripheral flange portion 216 of the movable plunger 215 is attracted to the auxiliary yoke 225 by the magnetic force of the permanent magnet 220, and by a combination of this and the urging force of the return spring 214, the condition in which the movable plunger 215 contacts with the auxiliary yoke 225 is maintained, with no unplanned downward movement due to external vibration, shock, or the like.

Figure 4A:
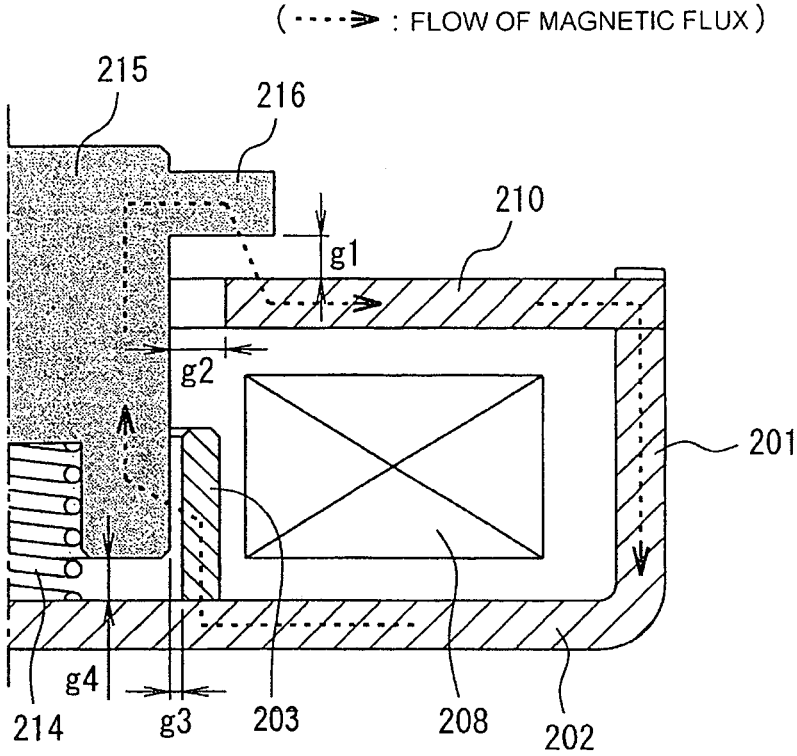
FIGS. 4(*a*), 4(*b*) are diagrams illustrating an action of attracting the movable plunger with the permanent magnet, wherein FIG. 4(*a*) is a partial sectional view showing a released condition and FIG. 4(*b*) is a partial sectional view showing an engaged condition.
Figure 4B:
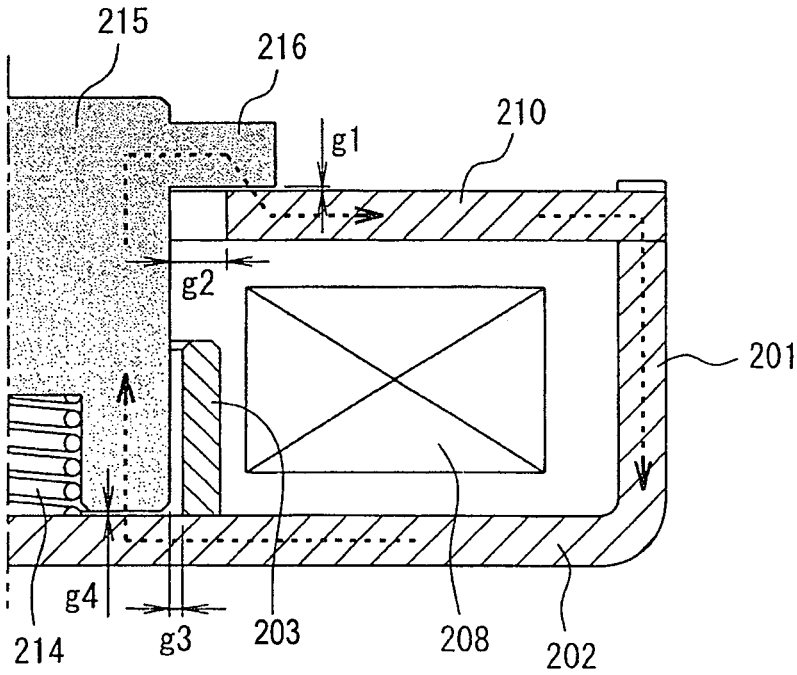

Also, in the released condition, as shown in FIG. 4(*a*), relationships between a gap g1 between the lower surface of the peripheral flange portion 216 of the movable plunger 215 and the upper surface of the upper magnetic yoke 210, a gap g2 between the outer peripheral surface of the movable plunger 215 and the through hole 210*a* of the upper magnetic yoke 210, a gap g3 between the outer peripheral surface of the movable plunger 215 and the cylindrical auxiliary yoke 203, and a gap g4 between the lower surface of the movable plunger 215 and the upper surface of the bottom plate portion 202 of the magnetic yoke 201 are set as below.

$g1<g2$ and $g3<g4$

Because of this, when exciting the exciting coil 208 in the released condition, the magnetic flux passes from the movable plunger 215 through the peripheral flange portion 216, passes through the gap g1 between the peripheral flange portion 216 and upper magnetic yoke 210, and reaches the upper magnetic yoke 210, as shown in FIG. 4(*a*). A closed magnetic circuit is formed from the upper magnetic yoke 210, through the U-shaped magnetic yoke 201 and through the cylindrical auxiliary yoke 203, as far as the movable plunger 215.

Because of this, it is possible to increase the magnetic flux density of the gap g1 between the lower surface of the peripheral flange portion 216 of the movable plunger 215 and the upper surface of the upper magnetic yoke 210, a larger attracting force is generated, and the movable plunger 215 is caused to descend against the urging force of the return spring 214 and the attracting force of the permanent magnet 220.

Consequently, the contact portions 130*a* of the movable contact 130 connected to the movable plunger 215 via the connecting shaft 131 contact with the contact portions 118*a* of the fixed contacts 111 and 112, and a current path is formed from the fixed contact 111, through the movable contact 130, toward the fixed contact 112, creating the engaged condition.

As the lower end surface of the movable plunger 215 nears the bottom plate portion 202 of the U-shaped magnetic yoke 201 on the engaged condition being created, as shown in FIG. 4(*b*), the heretofore described gaps g1 to g4 are as below.

$g1<g2$ and $g3<g4$

Because of this, the magnetic flux generated by the exciting coil 208 passes from the movable plunger 215 through the peripheral flange portion 216, and enters the upper magnetic yoke 210 directly, as shown in FIG. 4(*b*), while a closed magnetic circuit is formed from the upper magnetic yoke 210, through the U-shaped magnetic yoke 201, returning from the bottom plate portion 202 of the U-shaped magnetic yoke 201 directly to the movable plunger 215.

Because of this, a large attracting force acts in the gap g1 and gap g4, and the movable plunger 215 is held in the down position. Because of this, the condition continues wherein the contact portions 130*a* of the movable contact 130 connected to the movable plunger 215 via the connecting shaft 213 contact with the contact portions 118*a* of the fixed contacts 111 and 112.

Further, the movable plunger 215 is covered with a cap 230 formed in a bottomed tubular form made of a non-magnetic body, and a flange portion 231 formed extending outwardly in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Figure 5:
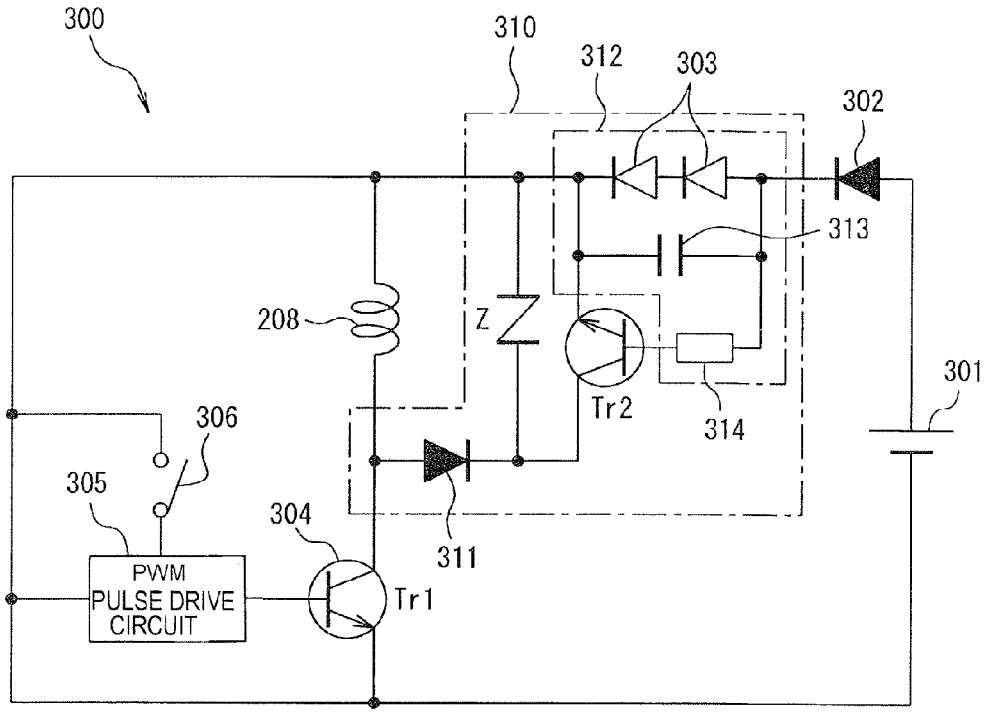
FIG. 5 is a circuit diagram showing a drive circuit that may be applied in the invention.

Also, a drive circuit 300 that drives the coil 208 of the electromagnet unit 200 is configured as shown in FIG. 5. The drive circuit 300 is such that the positive electrode side of a direct current power source 301 is connected to the positive electrode side of the coil 208 via a diode 302 and diodes 303, while the negative electrode side of the coil 208 is connected to the negative electrode side of the direct current power source 301 via an NPN transistor Tr1, which acts as a switching element.

Further, a pulse signal output from a pulse drive circuit 305 configured of a PWM oscillator circuit is supplied to the base of the NPN transistor Tr1. A power-on switch 306 is provided for the pulse drive circuit 305, and on the power-on switch 306 being changed from an off-state to an on-state, the power source voltage of the direct current power source 301 is detected, and when the power source voltage is normal, firstly, an engage pulse P1, with a comparatively long on-state period of predetermined width, is output, after which, when the engage pulse P1 changes to an off-state, a hold pulse P2, formed of a pulse width modulation signal with a short on-state period, is output at predetermined intervals. Then, when the power-on switch 306 is returned to an off-state, the output of the hold pulse P2 is stopped.

Also, a flywheel circuit 310 is connected in parallel to the coil 208. The flywheel circuit 310 includes a series circuit of a flywheel diode 311 connected in parallel to the coil 208 and an NPN transistor Tr2 acting as a switching element. Herein, the flywheel diode 311 is such that the anode thereof is connected to a connection point of the coil 208 and the collector of the NPN transistor Tr1, while the cathode is connected to the collector of the NPN transistor Tr2. Also, the emitter of the NPN transistor Tr2 is connected to a connection point of the diodes 303 and coil 208, while the base of the NPN transistor Tr2 is connected to a delay circuit 312.

The delay circuit 312 includes the diodes 303, and a charge and discharge capacitor 313 is connected in parallel to the diodes 303. Further, a connection point of the charge and discharge capacitor 313 and the anode of the diode 303 is connected via a resistor 314 to the base of the NPN transistor Tr2.

Next, a description will be given of an operation of the heretofore described embodiment.

For now, it is assumed that the fixed contact 111 is connected to, for example, a power supply source that supplies a large current, while the fixed contact 112 is connected to a load.

In this condition, it is assumed that the power-on switch 306 of the drive circuit 300 in the electromagnet unit 200 is in an off-state. In this case, as no pulse signal P1 or P2 is output from the pulse drive circuit 305, the NPN transistor Tr1 maintains an off-state condition.

Because of this, no current flows through the exciting coil 208, and it is thus in a non-energized state. Consequently, there exists a released condition wherein no exciting force causing the movable plunger 215 to descend is being generated in the electromagnet unit 200. In this released condition, the movable plunger 215 is urged in an upward direction away from the upper magnetic yoke 210 by the return spring 214.

Simultaneously with this, an attracting force caused by the permanent magnet 220 acts on the auxiliary yoke 225, and the peripheral flange portion 216 of the movable plunger 215 is attracted. Because of this, the upper surface of the peripheral flange portion 216 of the movable plunger 215 contacts with the lower surface of the auxiliary yoke 225.

As the movable contact 130 of the contact mechanism 101 is connected to the movable plunger 215 via the connecting shaft 131 in this condition, the contact portions 130*a* are separated by a predetermined distance upward from the contact portions 118*a* of the fixed contacts 111 and 112. Because of this, the current path between the fixed contacts 111 and 112 is in a cut-off condition, and the contact mechanism 101 is in a condition wherein the contacts are opened.

In this way, as the urging force of the return spring 214 and the attracting force of the ring-form permanent magnet 220 both act on the movable plunger 215 in the released condition, there is no unplanned downward movement of the movable plunger 215 due to external vibration, shock, or the like, and it is thus possible to reliably prevent malfunction.

Figures 6A, 6B, 6C, 6D, 6E:
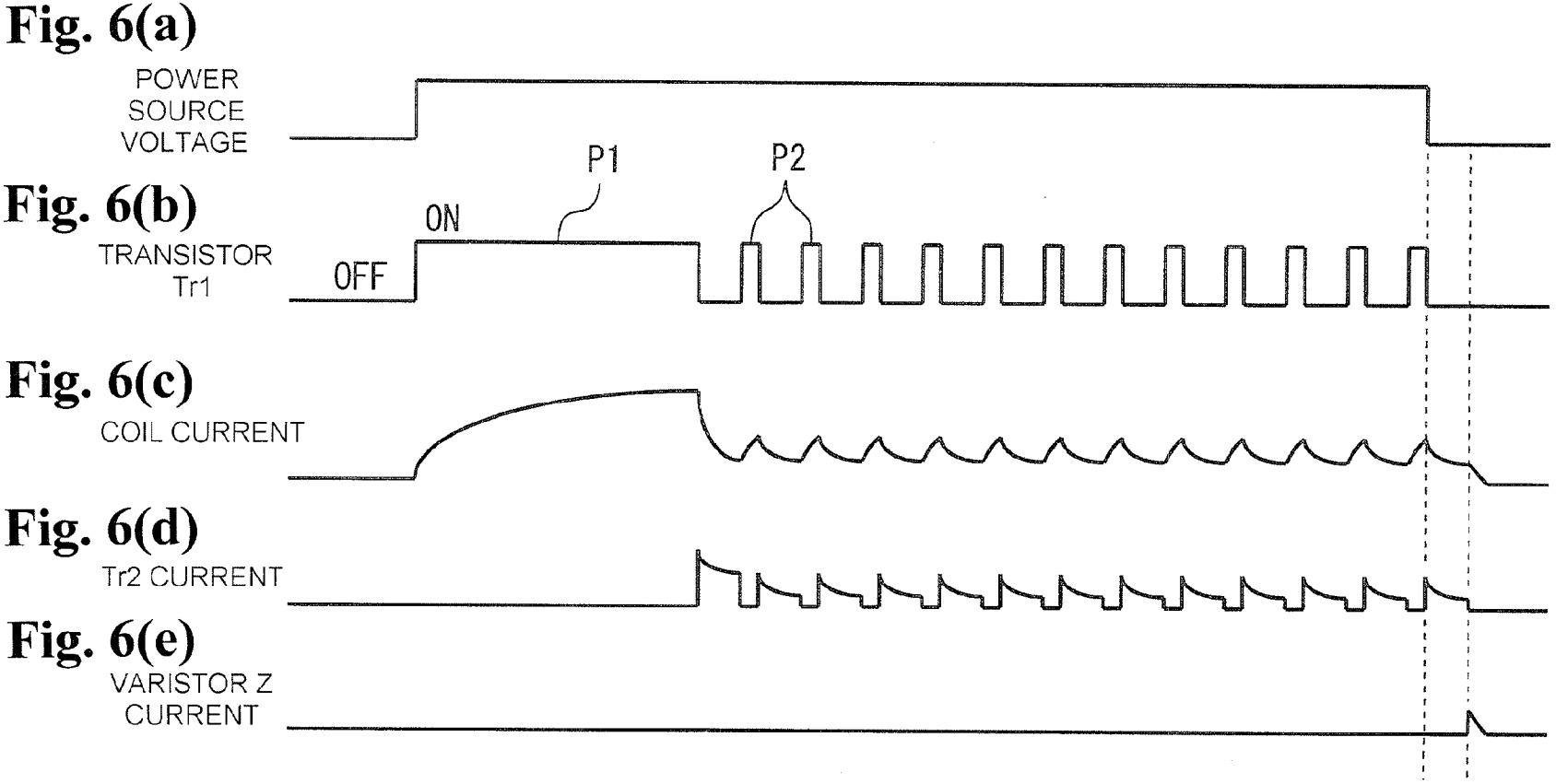
FIGS. 6(*a*)-6(*e*) are signal waveform diagrams accompanying a description of an operation of the drive circuit of FIGS. 4(*a*), 4(*b*).

On the power-on switch 306 of the drive circuit 300 being changed to an on-state from the released condition, the power source voltage of the direct current power source 301 is detected in the pulse drive circuit 305, it is determined whether or not the power source voltage is normal and, when the power source voltage is normal, the engage pulse P1 having an on-state period of predetermined width is output, as shown in FIG. 6(*b*).

As the engage pulse P1 is supplied to the base of the NPN transistor Tr1, the NPN transistor Tr1 changes to an on-state. Because of this, current flows through the coil 208, as shown in FIG. 6(*c*), and the movable plunger 215 is attracted downward by the exciting coil 208 against the urging force of the return spring 214 and the attracting force of the ring-form permanent magnet 220.

At this time, as shown in FIG. 4(*a*), the gap g4 between the bottom surface of the movable plunger 215 and the bottom plate portion 202 of the magnetic yoke 201 is large, and hardly any magnetic flux passes through the gap g4. However, the cylindrical auxiliary yoke 203 faces the lower outer peripheral surface of the movable plunger 215, and the gap g3 between the movable plunger 215 and the cylindrical auxiliary yoke 203 is set to be small in comparison with the gap g4.

Because of this, a magnetic path passing through the cylindrical auxiliary yoke 203 is formed between the movable plunger 215 and the bottom plate portion 202 of the magnetic yoke 201. Furthermore, the gap g1 between the lower surface of the peripheral flange portion 216 of the movable plunger 215 and the upper magnetic yoke 210 is set to be small in comparison with the gap g2 between the outer peripheral surface of the movable plunger 215 and the inner peripheral surface of the through hole 210*a* of the upper magnetic yoke 210. Because of this, the magnetic flux density between the lower surface of the peripheral flange portion 216 of the movable plunger 215 and the upper surface of the upper magnetic yoke 210 increases, and a large attracting force acts, attracting the peripheral flange portion 216 of the movable plunger 215.

Consequently, the movable plunger 215 descends swiftly against the urging force of the return spring 214 and the attracting force of the ring-form permanent magnet 220. The descent of the movable plunger 215 is stopped by the lower surface of the peripheral flange portion 216 contacting with the upper surface of the upper magnetic yoke 210, as shown in FIG. 4(*b*).

By the movable plunger 215 descending in this way, the movable contact 130 connected to the movable plunger 215 via the connecting shaft 131 also descends, and the contact portions 130*a* of the movable contact 130 contact with the contact portions 118*a* of the fixed contacts 111 and 112 with the contact pressure of the contact spring 134.

Because of this, there exists a closed contact condition wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction such as to cause the contacts of the movable contact 130 to open.

However, as the fixed contacts 111 and 112 are such that the C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions.

Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening.

Because of this, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

At this time, in the drive circuit 300, the charge and discharge capacitor 313 is charged by a drop in the voltage of the diodes 303 when current flows through the exciting coil 208. As the inter-terminal voltage of the capacitor 313 is supplied via the resistor 314 to the base of the NPN transistor Tr2, the NPN transistor Tr2 changes to an on-state. In the pulse drive circuit 305, on the output of the engage pulse P1 being stopped, the hold pulse P2 with the comparatively short on-state period is continuously output in a predetermined cycle. Because of this, when the hold pulse P2 is in an off-state, energy accumulated in the exciting coil 208 is released via the flywheel diode 311 and NPN transistor Tr2. Meanwhile, as the NPN transistor Tr1 changes to an on-state when the hold pulse P2 is in an on-state, a small current flows through the NPN transistor Tr1. At this time, no current flows through the NPN transistor Tr2.

Consequently, a small current continues to flow through the exciting coil 208, as shown in FIG. 6(*c*), and an engagement operation is maintained.

Subsequently, the power-on switch 306 is returned to an off-state in order to cause a return to the released condition. By so doing, the hold pulse P2 output from the pulse drive circuit 305 is stopped. Because of this, the supply of current from the direct current power source 301 to the exciting coil 208 is interrupted. At this time, the charge and discharge capacitor 313 is discharged by the current flowing through the diodes 303 being interrupted. Because of this, the inter-terminal voltage of the charge and discharge capacitor 313 drops, and the NPN transistor Tr2 changes to an off-state.

In this condition, the current of the exciting coil 208 flowing through the flywheel circuit 310 due to energy accumulated in the exciting coil 208 flows through a varistor Z, as shown in FIG. 6(*e*). As the resistance value of the varistor Z is high, the coil current attenuates sharply, and it is thus possible to accelerate release.

By the current flowing through the exciting coil 208 being interrupted in this way, the exciting force causing the movable plunger 215 to move downward in the electromagnet unit 200 stops. Because of this, the movable plunger 215 is raised by the urging force of the return spring 214, and the attracting force of the ring-form permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 contacts with the fixed contacts 111 and 112 for as long as contact pressure is applied by the contact spring 134. Subsequently, there starts an opened contact condition, wherein the movable contact 130 moves upward away from the fixed contacts 111 and 112 at the point at which the contact pressure of the contact spring 134 stops.

On the opened contact condition starting, an arc is generated between the contact portions 118*a* of the fixed contacts 111 and 112 and the contact portions 130*a* of the movable contact 130, and the condition in which current is conducted is continued due to the arc, but the arc can easily be extinguished by, for example, disposing permanent magnets opposed across the movable contact 130, and arranging so that mutually opposing faces of the permanent magnets have the same polarity.

In this way, according to the embodiment, as the ring-form permanent magnet 220 magnetized in the direction in which the movable plunger 215 is movable is disposed on the upper magnetic yoke 210, and the auxiliary yoke 225 is formed on the upper surface of the ring-form permanent magnet 220, it is possible to generate the attracting force to attract the peripheral flange portion 216 of the movable plunger 215 with the one ring-form permanent magnet 220.

Because of this, it is possible to carry out the fixing of the movable plunger 215 in the released condition with the magnetic force of the ring-form permanent magnet 220 and the urging force of the return spring 214, and it is thus possible to improve holding force with respect to malfunction shock.

Also, it is possible to reduce the urging force of the return spring 214, and thus possible to reduce the total load of the contact spring 134 and return spring 214. Consequently, it is possible to reduce the current energizing the exciting coil 208 in accordance with the amount by which the total load is reduced. Moreover, in the drive circuit 300, by maintaining the NPN transistor Tr1 in an on-state for a predetermined time with the engage pulse P1 when turning on the power, causing an engagement operation to be carried out by continuously causing current to flow through the exciting coil 208, and subsequently supplying the hold pulse P2 formed of a pulse width modulation signal to the NPN transistor Tr1, it is possible to reduce the amount of current supplied to the exciting coil 208. The NPN transistor Tr2 of the flywheel circuit 310 is put into an on-state in the condition in which engagement is maintained, and the condition in which engagement is maintained, wherein a small coil current of the exciting coil 208 is caused to flow through the flywheel diode 311 and NPN transistor Tr2, is thus maintained. Then, by the NPN transistor Tr2 being put into an off-state when a release operation is carried out, it is possible to obtain a swift release operation by the energy accumulated in the exciting coil 208 being consumed by the varistor Z connected in parallel to the NPN transistor Tr2. Because of this, it is possible to simplify the configuration of the drive circuit 300 for this purpose.

In the first embodiment, a description has been given of a case in which the NPN transistors Tr1 and Tr2 are applied as semiconductor switching elements but, not being limited to this, it is possible to apply another arbitrary semiconductor switching element, such as a field effect transistor or MOS field effect transistor.

Next, a description will be given of a second embodiment of the invention, based on FIG. 7 and FIG. 8.

In the second embodiment, the configuration of the drive circuit 300 is changed.

Figure 7:
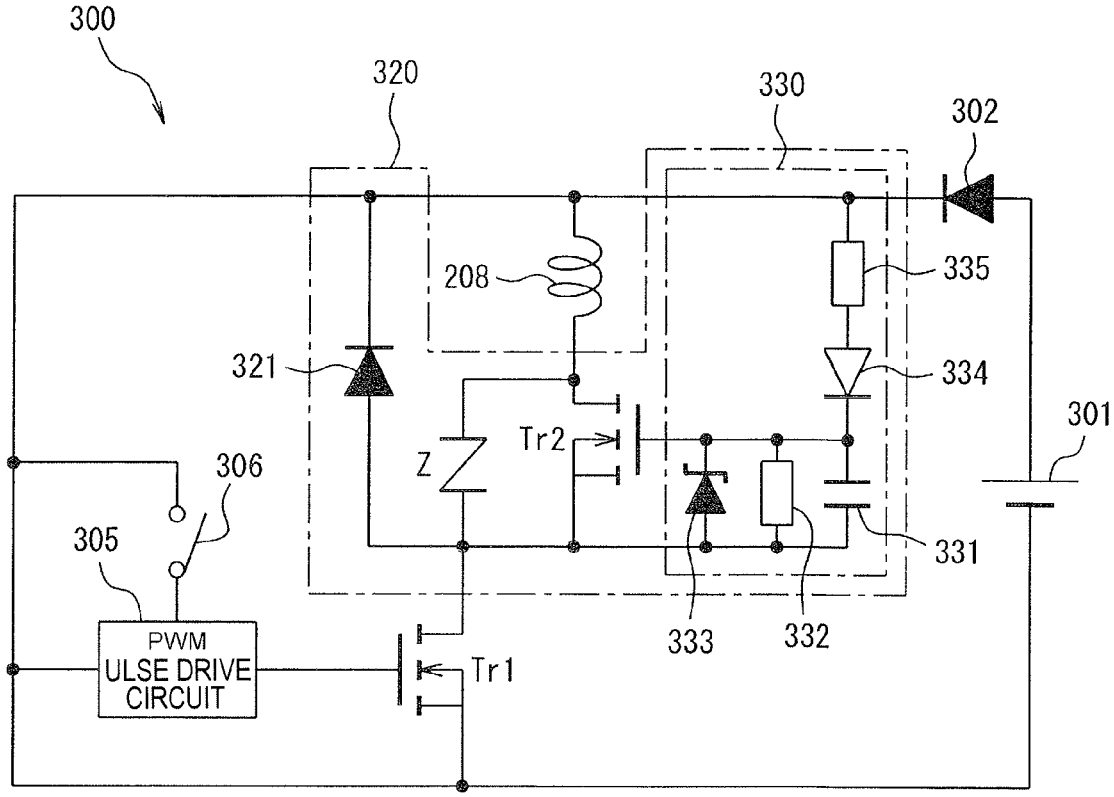
FIG. 7 is a circuit diagram of a drive circuit showing a second embodiment of the invention.

That is, in the second embodiment, the drive circuit 300 is configured as shown in FIG. 7. The drive circuit 300 is such that the diode 302, the exciting coil 208, an N-channel MOS field effect transistor Tr2 configuring a flywheel circuit 320, and an N-channel MOS field effect transistor Tr1 are connected in series to the direct current power source 301.

Further, the pulse signals P1 and P2 of the pulse drive circuit 305 are supplied to the gate of the MOS field effect transistor Tr1.

Also, the flywheel circuit 320 is such that the varistor Z, acting as a high impedance element, is connected in parallel to the MOS field effect transistor Tr2, and a flywheel diode 321 is connected between a connection point of the MOS field effect transistor Tr2 and varistor Z and MOS field effect transistor Tr1 and the positive electrode side of the exciting coil 208. Furthermore, the flywheel circuit 320 has a delay circuit 330 that drives the gate of the MOS field effect transistor Tr2.

The delay circuit 330 is such that a parallel circuit of a charge and discharge capacitor 331, a discharge resistor 332, and a Zener diode 333 is connected between the source and gate of the MOS field effect transistor Tr2. Also, a connection point of the charge and discharge capacitor 331 and the gate of the MOS field effect transistor Tr2 is connected to a connection point of the exciting coil 208 and diode 302 via a diode 334, in reverse direction, and furthermore, via a resistor 335.

According to the drive circuit 300, in the released condition wherein no pulse signal is output from the pulse drive circuit 305, the current path for the exciting coil 208 is shut off when the MOS field effect transistor Tr1 is in an off-state, and the current path of the charge and discharge capacitor 331 is also cut off. Because of this, the charge and discharge capacitor 331 takes on a discharging condition, and the MOS field effect transistor Tr2 also maintains an off-state.

Figures 8A, 8B, 8C, 8D, 8E:
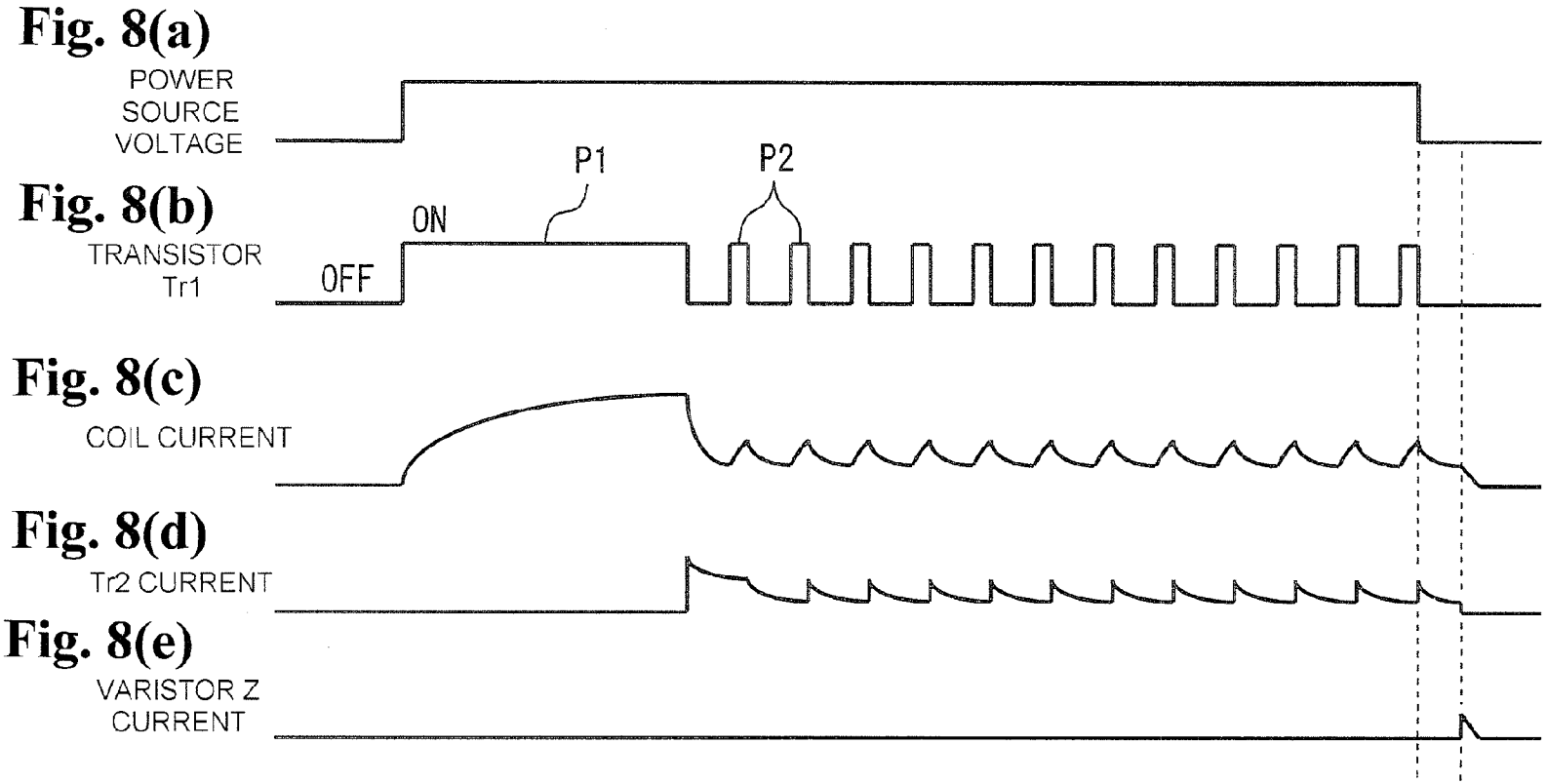
FIGS. 8(*a*)-8(*e*) are signal waveform diagrams accompanying a description of an operation of the drive circuit of FIG. 7.

When the power-on switch 306 is changed to an on-state from the released condition, the engage pulse P1 with a comparatively long on-state period shown in FIG. 8(*b*) is output from the pulse drive circuit 305. Because of this, the MOS field effect transistor Tr1 changes to an on-state.

Because of this, a charge path is formed for the charge and discharge capacitor 331, and current from the direct current power source 301 is supplied via the diode 302, resistor 335, and diode 334 to the charge and discharge capacitor 331, whereby the charge and discharge capacitor 331 is charged. As the inter-terminal voltage of the charge and discharge capacitor 331 is applied between the gate and source of the MOS field effect transistor Tr2, the MOS field effect transistor Tr2 changes to an on-state.

Consequently, a current path is formed from the direct current power source 301 through the diode 302, exciting coil 208, MOS field effect transistor Tr2, and MOS field effect transistor Tr1, returning to the direct current power source 301. Because of this, a large coil current flows through the exciting coil 208, as shown in FIG. 8(*c*), generating an exciting force that attracts the movable plunger 215 against the urging force of the return spring 214 and the attracting force of the permanent magnet 220. The movable plunger 215 is caused to descend by the exciting force, and the movable contact 130 contacts with the fixed contacts 111 and 112 with the contact pressure of the contact spring 134, creating the engaged condition.

Subsequently, in the same way as in the first embodiment, the hold pulse P2 is output from the pulse drive circuit 305, as shown in FIG. 8(*b*), and the turning on and off of the MOS field effect transistor Tr1 is controlled by the hold pulse P2.

In this condition, when the MOS field effect transistor Tr1 is in an on-state, a small current flows through the exciting coil 208, MOS field effect transistor Tr2, and MOS field effect transistor Tr1. Meanwhile, when the MOS field effect transistor Tr1 is in an off-state, the coil current of the exciting coil 208 flows through the MOS field effect transistor Tr2 and flywheel diode 321.

Because of this, a small coil current flows through the MOS field effect transistor Tr2, as shown in FIG. 8(*d*). As a result of this, the coil current shown in FIG. 8(*c*) flows through the exciting coil 208, creating a condition wherein the engagement operation is maintained.

When the power-on switch 306 is put into an off-state from the condition wherein the engagement operation is maintained, the output of the hold pulse P2 from the pulse drive circuit 305 is stopped, because of which the MOS field effect transistor Tr1 continues to be in an off-state. When this condition is reached, the energizing of the exciting coil 208 by the MOS field effect transistor Tr1 is interrupted, and the charge path of the charge and discharge capacitor 331 is also shut off. Because of this, the charge of the charge and discharge capacitor 331 is released via the resistor 332, and the MOS field effect transistor Tr2 changes to an off-state.

At this time, energy accumulated in the exciting coil 208 is released through the flywheel diode 321 via the varistor Z, as shown in FIG. 8(*e*), the coil energy is consumed due to the high resistance of the varistor Z, and it is possible to carry out a swift release operation.

Consequently, it is possible to obtain the same operation and effect as in the first embodiment.

Figure 9:
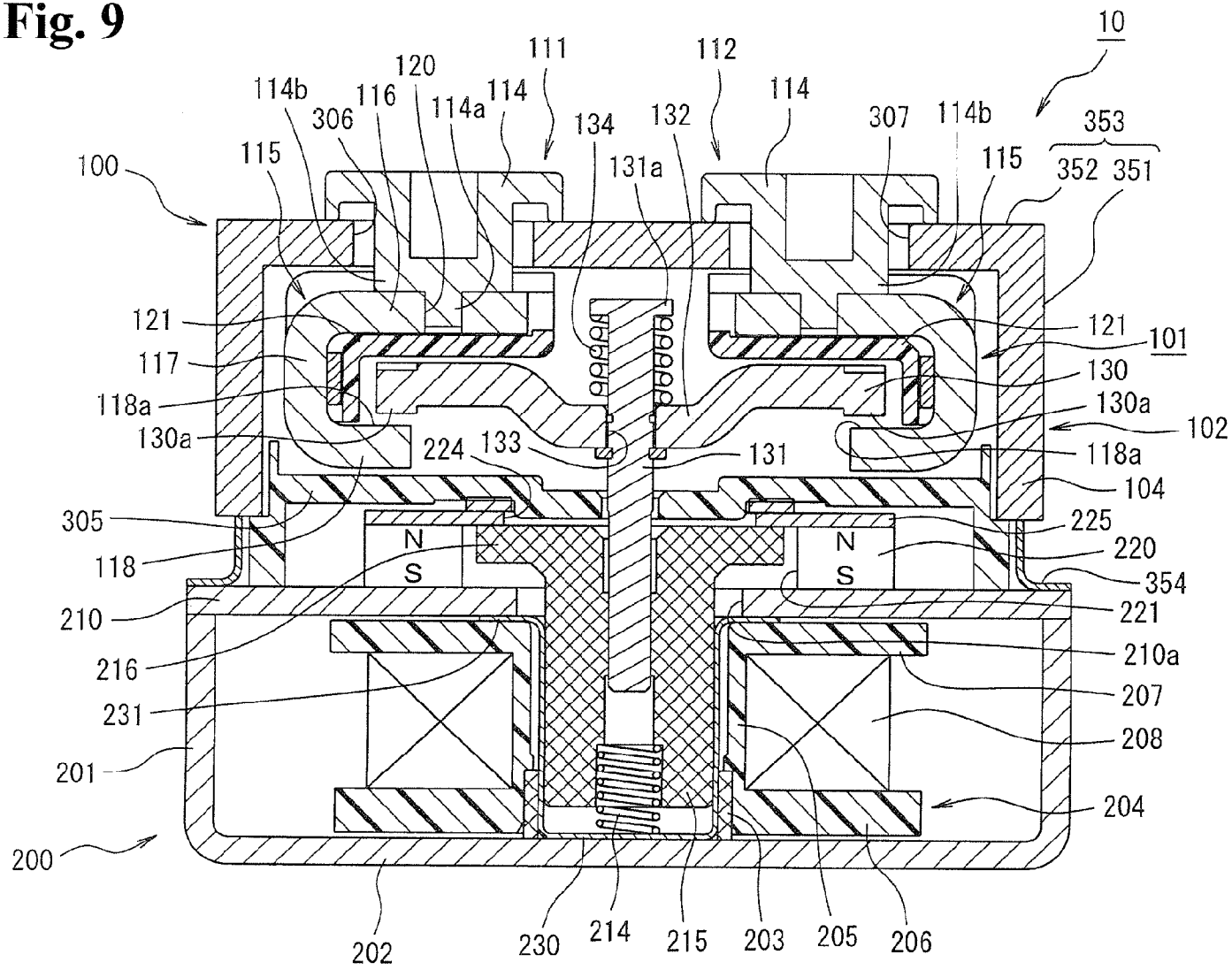
FIG. 9 is a sectional view showing a modification example of a contact device of the invention.

Also, in the heretofore described embodiments, a description has been given of a case wherein the contact housing case 102 of the contact device 100 is configured of the tubular body 104 and fixed contact support insulating substrate 105 but, not being limited to this, it is possible to adopt another configuration. For example, as shown in FIG. 9, the contact housing case 102 may be formed by a tubular portion 351 and an upper surface plate portion 352 closing off the upper end of the tubular portion 351 being formed integrally of a ceramic or a synthetic resin material, forming a tub-form body 353, a metal foil being formed on an opened end surface side of the tub-form body 353 by a metalizing process, and a metal connection member 354 being seal joined to the metal foil.

Also, the contact mechanism 101 not being limited to the heretofore described configuration either, it is possible to apply any configuration of contact mechanism.

Figure 10A:
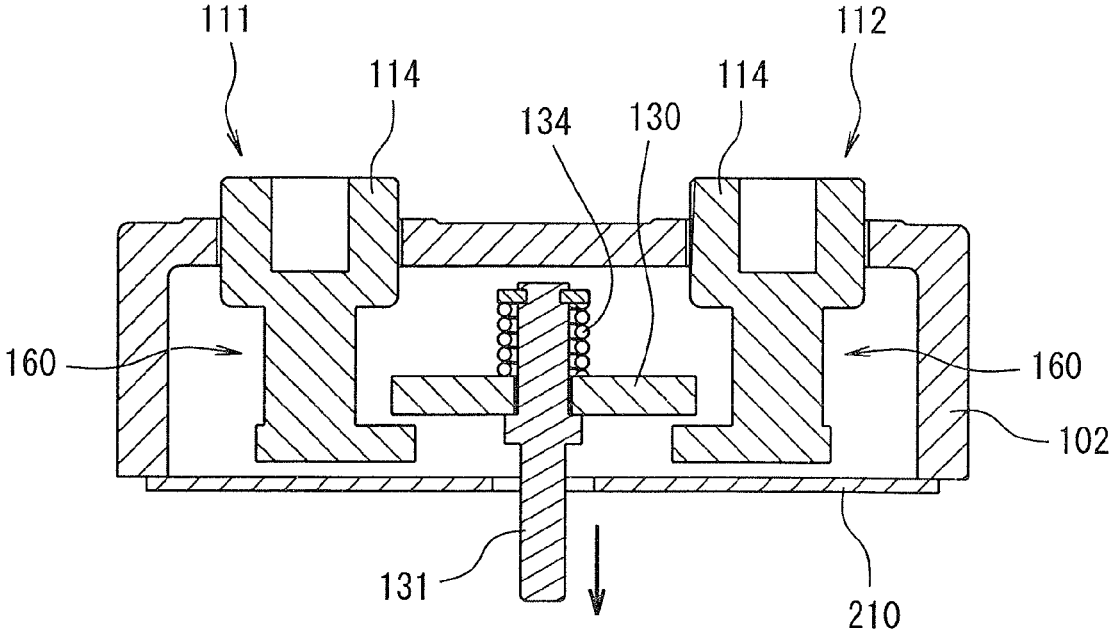
FIGS. 10(*a*), 10(*b*) are diagrams showing a modification example of a contact mechanism in the contact device of the invention, wherein FIG. 10(*a*) is a sectional view and FIG. 10(*b*) is a perspective view.
Figure 10B:
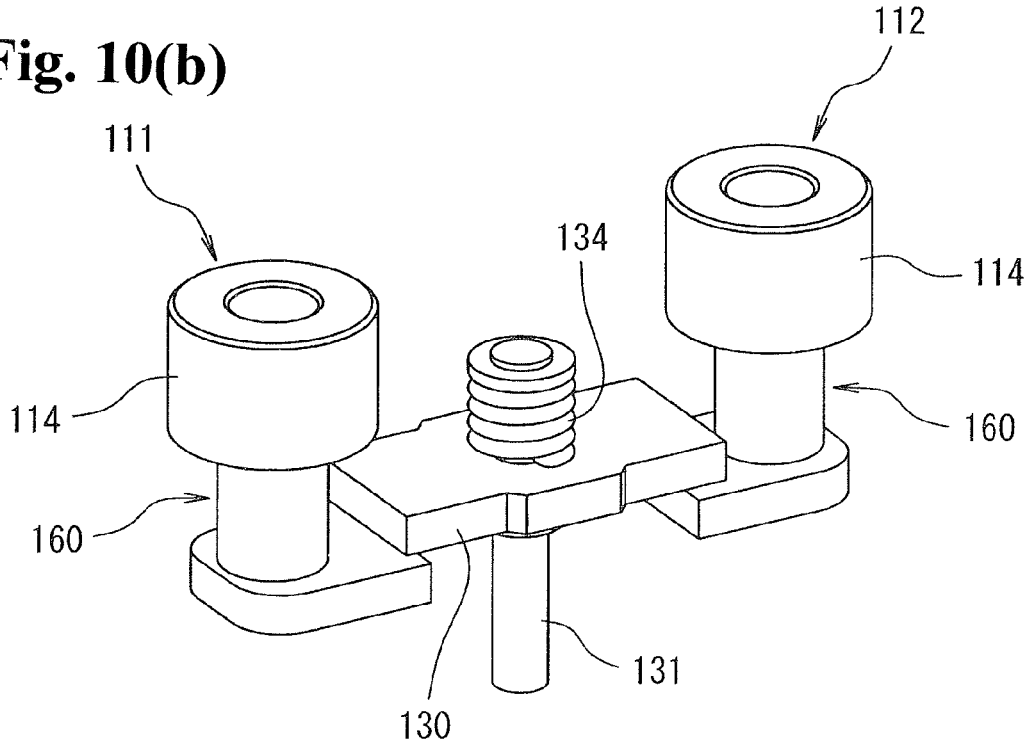

For example, an L-shaped portion 160, of a form such that the upper plate portion 116 of the C-shaped portion 115 is omitted, may be connected to the support conductor portion 114, as shown in FIGS. 10(*a*) and 10(*b*). In this case too, in the closed contact condition wherein the movable contact 130 contacts with the fixed contacts 111 and 112, it is possible to cause magnetic flux generated by the current flowing through a vertical plate portion of the L-shaped portion 160 to act on portions in which the fixed contacts 111 and 112 and the movable contact 130 contact. Because of this, it is possible to increase the magnetic flux density in the portions in which the fixed contacts 111 and 112 and the movable contact 130 contact, generating a Lorentz force that opposes the electromagnetic repulsion force.

Figure 11A:
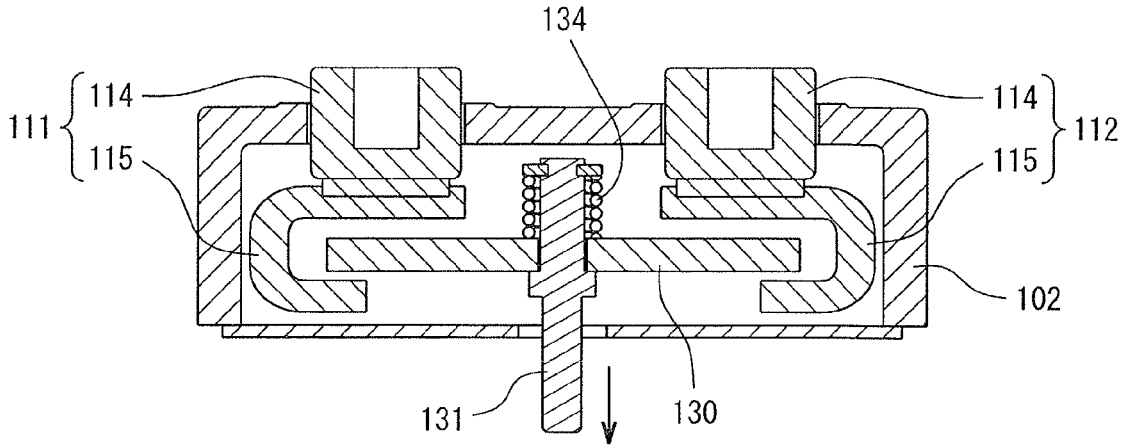
FIGS. 11(*a*), 11(*b*) are diagrams showing another modification example of the contact device of the invention, wherein FIG. 11(*a*) is a sectional view and FIG. 11(*b*) is a perspective view.
Figure 11B:
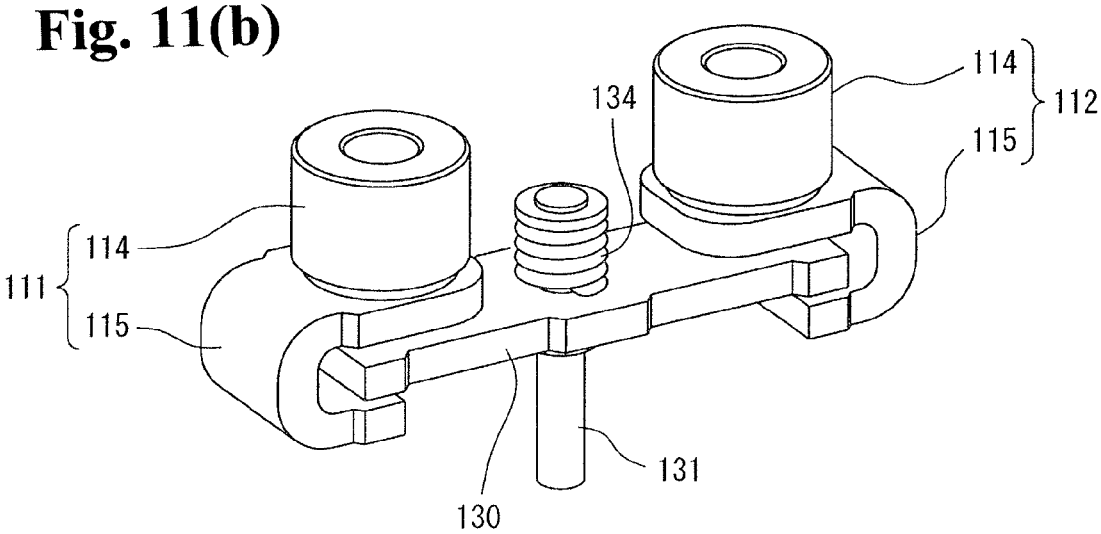

Also, the depressed portion 132 may be omitted, forming a flat plate, as shown in FIGS. 11(*a*) and 11(*b*).

Also, in the heretofore described first and second embodiments, a description has been given of a case wherein the connecting shaft 131 is screwed to the movable plunger 215 but, not being limited to screwing, it is possible to apply any connection method, and furthermore, the movable plunger 215 and connecting shaft 131 may also be formed integrally.

Also, in the heretofore described first and second embodiments, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but not being limited to this. That is, a positioning large diameter portion may be formed protruding in a radial direction in the C-ring position of the connecting shaft 131, the contact spring 134 disposed after the movable contact 130 contact with the large diameter portion, and the upper end of the contact spring 134 fixed with the C-ring.

Also, in the heretofore described first and second embodiments, a description has been given of a case wherein a hermetic receptacle is configured of the contact housing case 102 and cap 230, and gas is encapsulated inside the hermetic receptacle but, not being limited to this, the gas encapsulation may be omitted when the interrupted current is small.

REFERENCE SIGNS LIST

10 . . . Electromagnetic contactor, 11 . . . External insulating receptacle, 100 . . . Contact device, 101 . . . Contact mechanism, 102 . . . Contact housing case, 104 . . . Tubular body, 105 . . . Fixed contact support insulating substrate, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Connecting shaft, 132 . . . Depressed portion, 134 . . . Contact spring, 140 . . . Insulating cylinder, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke, 300 . . . Drive circuit, 301 . . . Direct current power source, 302 . . . Diode, 303 . . . Diode, Tr1 . . . NPN transistor, 305 . . . Pulse drive circuit, 306 . . . Power-on switch, Tr1 . . . NPN diode, 310 . . . Flywheel circuit, 311 . . . Flywheel diode, 312 . . . Delay circuit, 313 . . . Charge and discharge capacitor, 314 . . . Resistor, Z . . . Varistor, 320 . . . Flywheel circuit, 321 . . . Flywheel diode, 330 . . . Delay circuit, 331 . . . Charge and discharge capacitor, 332 . . . Discharge resistor, 333 . . . Zener diode, 334 . . . Diode, 335 . . . Resistor

What is claimed is:

1. An electromagnetic contactor, comprising:

a pair of fixed contacts disposed with a predetermined interval maintained therebetween;

a movable contact disposed to contact to and separate from the pair of fixed contacts;

an electromagnet unit to drive the movable contact; and a drive circuit driving the electromagnet unit, wherein the electromagnet unit includes at least:

a magnetic yoke having a bottom plate portion, an upper portion magnetic yoke disposed over the magnetic yoke opposite to the bottom plate portion, and having a through hole, a cylindrical auxiliary yoke protruding from the bottom plate portion toward the upper portion magnetic yoke, a movable plunger connected to the movable contact and having a peripheral flange portion disposed above the upper portion magnetic yoke, and an end portion disposed inside the cylindrical auxiliary yoke, a return spring disposed on the bottom plate portion to urge the end portion of the movable plunger toward the upper portion magnetic yoke, a coil disposed between the upper portion magnetic yoke and the bottom plate portion of the magnetic yoke to move the movable plunger, and a ring-form permanent magnet disposed on the upper portion magnetic yoke to enclose the peripheral flange portion of the movable plunger and magnetized in a moving direction of the movable plunger, the drive circuit includes:

a power source to supply power to the coil;

a pulse drive circuit to output and supply to the coil an engage pulse causing the movable plunger to perform an attracting operation and a hold pulse maintaining the attracting operation when the movable plunger is subject to the attracting operation by the engage pulse, and a flywheel circuit having a semiconductor switching element connected in parallel to the coil, and the movable plunger is arranged to have a first gap between a lower surface of the peripheral flange portion of the movable plunger and an upper surface of the upper portion magnetic yoke, and a second gap between an outer peripheral surface of the movable plunger and a side surface of the upper portion magnetic yoke in the through hole, the first gap being less than the second gap so that a magnetic flux density between the first gap is greater than the second gap to form a magnetic circuit in which a magnetic field passes through the peripheral flange of the movable plunger, the upper portion magnetic yoke, the magnetic yoke, the cylindrical auxiliary yoke, and the end portion of the movable plunger.

2. An electromagnetic contactor according to claim 1, wherein the flywheel circuit further comprises:

a series circuit of the semiconductor switching element and a flywheel diode connected in parallel to the coil, a high impedance element connected in parallel to the semiconductor switching element, and a switch control circuit to control turning on and off of the semiconductor switching element based on a coil supply current.

3. An electromagnetic contactor according to claim 2, wherein the movable plunger is arranged to have a third gap between the outer peripheral surface of the movable plunger and the cylindrical auxiliary yoke, and a fourth gap between a lower surface of the end portion of the movable plunger and an upper surface of the bottom plate portion of the magnetic yoke so that when the peripheral flange portion of the movable plunger separates from the upper portion magnetic yoke, the third gap is less than the fourth gap, and when the peripheral flange portion of the movable plunger contacts the upper portion magnetic yoke, the third gap is greater than the fourth gap.

4. An electromagnetic contactor according to claim 3, further comprising a cap disposed between the movable plunger and the cylindrical auxiliary yoke and having a flange portion extending outwardly in a radial direction to seal join to a lower surface of the upper portion magnetic yoke, the cap being formed from a non-magnetic body.

5. An electromagnetic contactor according to claim 4, wherein the drive circuit further comprises a first diode disposed between the power source and a positive electrode side of the coil, and another semiconductor switching element disposed between the power source and a negative electrode side of the coil.

6. An electromagnetic contactor according to claim 5, wherein the flywheel circuit further comprises a delay circuit including a second diode, and a charge and discharge capacitor connected in parallel to the second diode.

7. An electromagnetic contactor according to claim 5, wherein the flywheel circuit further comprises a delay circuit disposed between a source and a gate of the semiconductor switching element, the delay circuit having a charge and discharge capacitor, a discharge resistor, and a second diode connected in parallel among each other.

8. An electromagnetic contactor according to claim 7, wherein the delay circuit further comprises a resistor and a third diode connected in series.

* * * * *

UNITED STATES PATENT AND TRADEMARK OFFICE

CERTIFICATE OF CORRECTION

PATENT NO. : 9,048,051 B2
APPLICATION NO. : 13/978088
DATED : June 2, 2015
INVENTOR(S) : Yasuhiro Naka et al.

It is certified that error appears in the above-identified patent and that said Letters Patent is hereby corrected as shown below:

In the specification

Please change column 7, line 34, from "g1<g2 and g3<g4" to --g1<g2 and g3>g4--.

Signed and Sealed this
Thirteenth Day of October, 2015

Michelle K. Lee

Michelle K. Lee
*Director of the United States Patent and Trademark Office*